US007146829B1

(12) United States Patent
Su

(10) Patent No.: US 7,146,829 B1
(45) Date of Patent: Dec. 12, 2006

(54) YARN CLAMP ASSEMBLY OF A KNITTING MACHINE

(75) Inventor: Po-Hao Su, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 0 days.

(21) Appl. No.: 11/272,774

(22) Filed: Nov. 15, 2005

(51) Int. Cl.
*D04B 9/12* (2006.01)

(52) U.S. Cl. ..... 66/92

(58) Field of Classification Search ..... 66/91, 66/92, 93, 90
See application file for complete search history.

(56) References Cited

U.S. PATENT DOCUMENTS 3,041,859 A * 7/1962 Lie et al. ..... 66/92
4,592,212 A * 6/1986 Schmidt ..... 66/91
5,463,882 A * 11/1995 Yeh ..... 66/92
6,094,944 A * 8/2000 Schmidt ..... 66/92

FOREIGN PATENT DOCUMENTS

| | | |
|---|---|---|
| TW | 208294 | 6/1993 |
| TW | 235625 | 12/1994 |
| TW | 300565 | 3/1997 |
| TW | 345204 | 11/1998 |
| TW | 388416 | 4/2000 |

* cited by examiner

*Primary Examiner*—Danny Worrell
(74) *Attorney, Agent, or Firm*—Birch, Stewart, Kolasch & Birch, LLP

(57) ABSTRACT

A yarn clamp assembly of a knitting machine uses a wrap knitting method to knit a fabric having a side of a loop surface or a cut pile surface, and the base yarn of the base fabric forms two fixing loops fixed onto the wool yarn of the loop or the wool yarn during repeated knitting processes, so that the loop or the wool yarn will not be loosened easily from the base fabric due to the fixing effect of the two fixing loops.

8 Claims, 5 Drawing Sheets

YARN CLAMP ASSEMBLY OF A KNITTING MACHINE

FIELD OF THE INVENTION

The present invention relates to a yarn clamp assembly of a knitting machine, and more particularly to a yarn clamp assembly of a knitting machine that enhances the fixation of the bottom of additional yarns.

BACKGROUND OF THE INVENTION

As the weaving techniques advance, various different fabrics such as the invention of the towel fabrics are produced for our use. The soft surface and strong water absorbability function of the towel fabrics make the towel fabric to be used extensively in daily products. Many knitting methods primarily use a normal knitting method to introduce yarns with additional effects to form a soft surface as disclosed in R.O.C. Pat. Publication Nos. 300565, and 388416 and 345204 filed by the inventor of the present invention. These patents disclose a wrap knitting method and a counter wrap knitting method to knit a single knitted towel fabric structure to produce a loop with soft surface. As we all know, the surface of the towel fabric is comprised of many loops which are different from the base fabric. Since the bottoms of these loops are fixed into the base fabric when the base yarns forming the base fabric are woven, and another end of the loop is a free end so that the surface becomes soft and the water content is increased. However, the towel fabric has a shortcoming that the loops will be loosened from the base fabric and damage the towel fabric if a loop is pulled. Therefore, the prior art adds glues on the base fabric to increase the coupling strength between the loop and the base fabric. However, the towel fabric so produced is not applicable for daily use that requires a direct contact of the towel fabric with skin.

As more attention is paid to the environmental protection nowadays, furs which are welcome by most ladies are banned due to pubic opinions. Therefore, the textile industry tries to find a substitute to meet the consumer's requirement, and such substitute method uses a counter wrap knitting method to knit a loop having a surface similar to that of a towel fabric, and then cuts the loop into independent yarns by a cutter, and thus the yarn so produced is very similar to the surface of the fur regardless of its appearance or touch. This method has been disclosed in R.O.C. Pat. Publication Nos. 208294 and 235625, and the counter wrap knitting used for knitting a fabric having yarn wools with an appearance similar to furs has an advantage that its yarn wool will not easily fall off. However, the counter wrap knitting method is not easy to achieve. On the other hand, the wrap knitting method is easy to achieve, but it has a problem that the yarn will fall off easily.

In summation to the description above, the fabric regardless of the loop of the towel fabric or the artificial fur woven by the wrap knitting method may be damaged easily because both are loop or independent yarn with its bottom not wrapped securely into the base fabric by the base yarn. If the fabric is made by a gluing method or a counter wrap knitting method, then the same issue as described above will exist.

Since the knitting technology cannot be broken through, therefore the length of the foregoing loop or yarn wool is limited (to approximately 3 mm). If a consumer (such as one who loves long furs) needs longer loops or longer yarn wools, then the present technology cannot meet the consumer's requirement. Finding a way of fixing the foregoing loop or yarn wool by a wrap knitting method and increasing the length of the loop and the yarn wool are an important subject for manufacturers in the related field to solve.

SUMMARY OF THE INVENTION

The primary objective of the present invention is to overcome the foregoing shortcomings and avoid the existing deficiency by providing a yarn clamp assembly of a knitting machine to be installed to a circular knitting machine. The yarn clamp assembly comprises two knitting needles disposed between a plurality of transversal and separate entry needles for hooking and forming a base yarn at the bottom surface and a wool yarn additionally formed on a loop. When the two knitting needles weave the bottom surface, the base yarn forms two fixing loops coupled on the wool yarn, so as to enhance the fastening effect of the loop at the bottom surface.

Another objective of the present invention is to provide a fabric having a cut pile surface, so that the cut pile has a good fastening effect. An entry needle forming a loop includes a cutter for cutting the loop to produce yarn wool, and the yarn wool is fixed onto the bottom by fixing the loop by the foregoing yarn clamp assembly of the knitting machine.

A further objective of the present invention is to add the foregoing loop or yarn wool. The length of the base fabric is extended to increase the distance between the needle disc and the entry needle barrel of the knitting machine, so that the distance of the vertices of the base fabric and the loop is increased, and the length of the loop or yarn wool is increased.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 5:
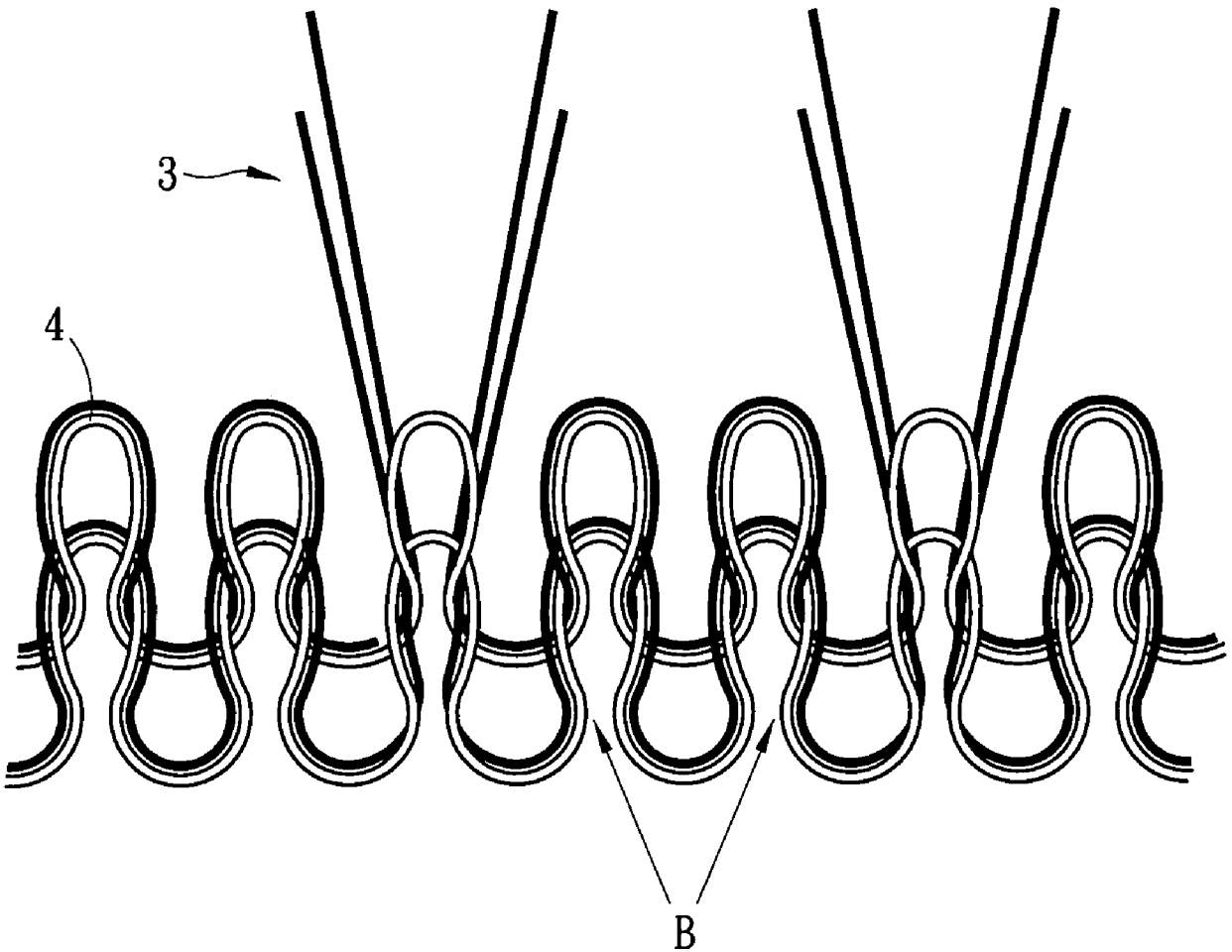
FIG. 5 is a schematic enlarged view of a fixed loop of the invention.

Referring to FIGS. 1, 2, 3, and 5 respectively for the perspective view, the action, the lateral view and the enlarged view of fixing a loop according to the present invention, the yarn clamp assembly of a knitting machine knits a fabric having a loop on a side by a wrap knitting method and comprises a plurality of entry needles 20 transversally and separately disposed on the entry needle barrel or dial 2, and the plurality of entry needles form a plurality of needling spaces among them, such that a needle cylinder or disc 1 disposed on the knitting machine comprises a plurality of knitting needles such as the first and second knitting needle 10, 11 disposed in each of the needling space. Each knitting needle includes a yarn clamping section 101, 111 for hooking the yarn back and forth. The yarn includes a wool yarn 3 formed on the loop surface and a base yarn 4 formed on the fabric base of the fabric. The wool yarn 3 is hooked by the first knitting needle 10 and the second knitting needle 11 on both sides of the entry needle 20 at a circular position of the wool yarn and coupled to the entry needle 20 to form the top of the loop 30. The wool yarn 3 is further hooked at a circular position of a base yarn by the first knitting needle 10 and second knitting needle 11 in the needling spaces and hooked to the wool yarn 3 to hook the base yarn 4 and form two fixing loops B of the wool yarn 3 and the bottom of the loop 30 (as shown in FIG. 5).

Figure 1:
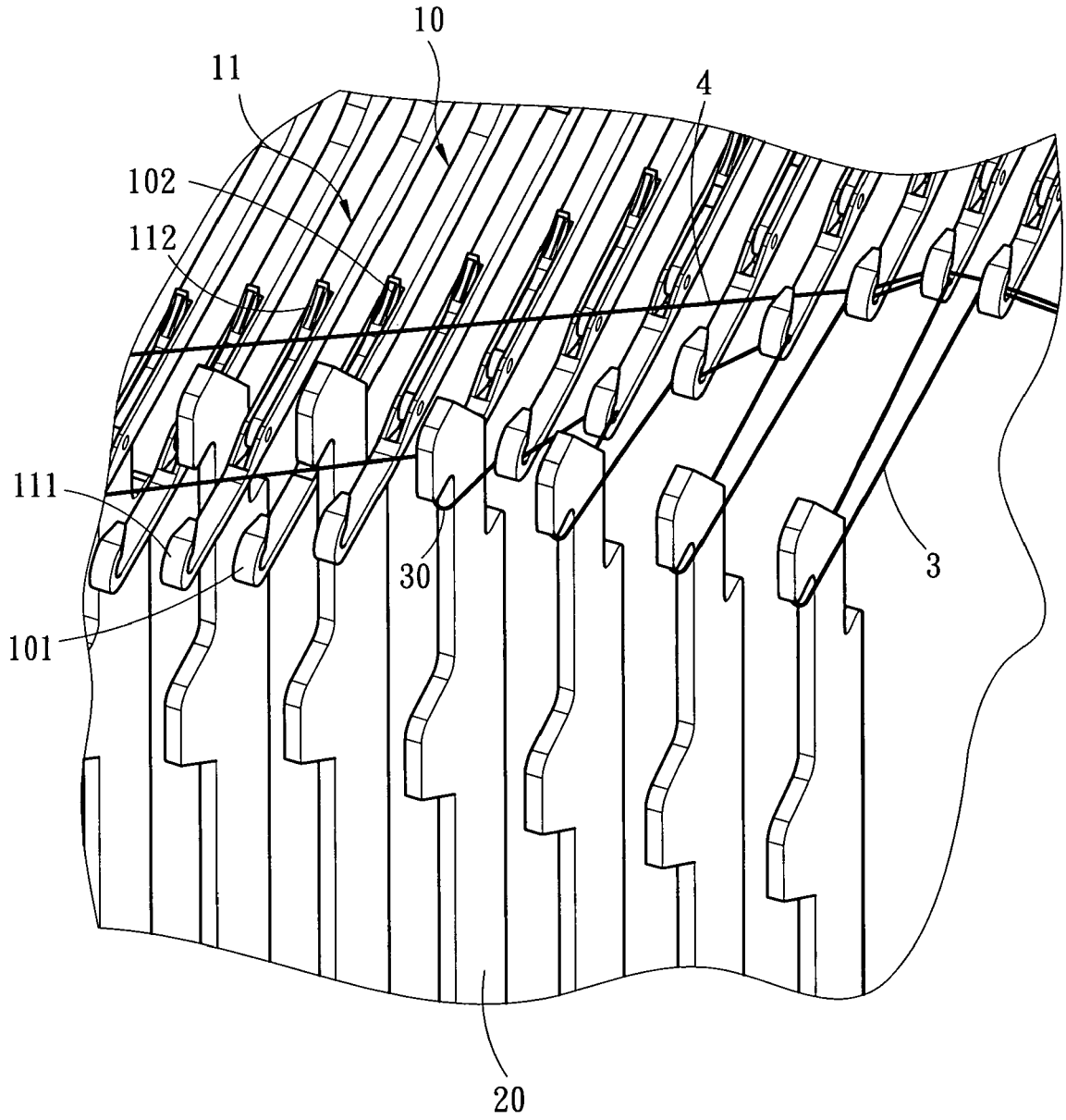
FIG. 1 is a schematic view of the appearance of the invention.
Figure 2:
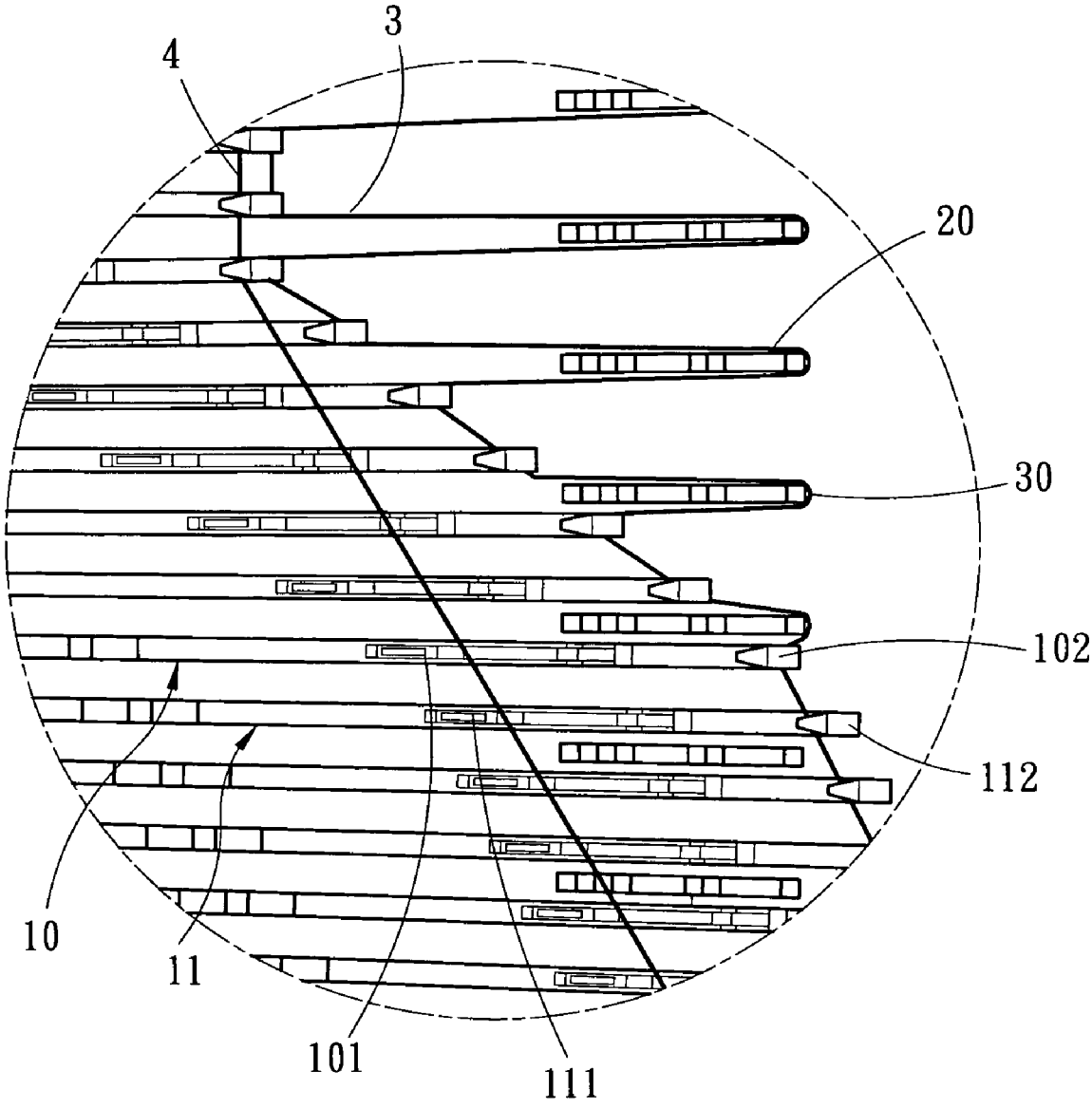
FIG. 2 is a schematic view of the actions of the invention.

Referring to FIGS. 2 and 5 for the detailed flow chart of the actions and the action of fixing the two fixing loops B to the base fabric, the needle disc 1 drives the plurality of first and second knitting needles 10, 11 to move during the action, and the entry needle barrel 2 drives the plurality of entry needle 20 to move, so that the first and second knitting needles 10, 11 repeat the hooking of yarns back and forth at the needling spaces of two adjacent entry needles 20. In a weaving opening, two loops 30 can be formed, and two adjacent entry needles 20 and four adjacent knitting needles 10, 11 of the two entry needles 20 are considered as a weaving opening. After two loops 30 are formed according to the aforementioned method, the wool yarn 3 hooked by the first knitting needle 10 and the second knitting needle 11 at the external weaving opening are woven into the base fabric with the full needle method by the base yarn 4, and the wool yarn 3 hooked by the first knitting needle 10 and the second knitting needle 11 disposed at the internal side of the weaving opening is woven into the base yarn 4 to form two fixing loops B similarly by the full needle method, and the two fixing loops B have the effect of fixing the two loops 30 onto the base fabric.

Figure 3:
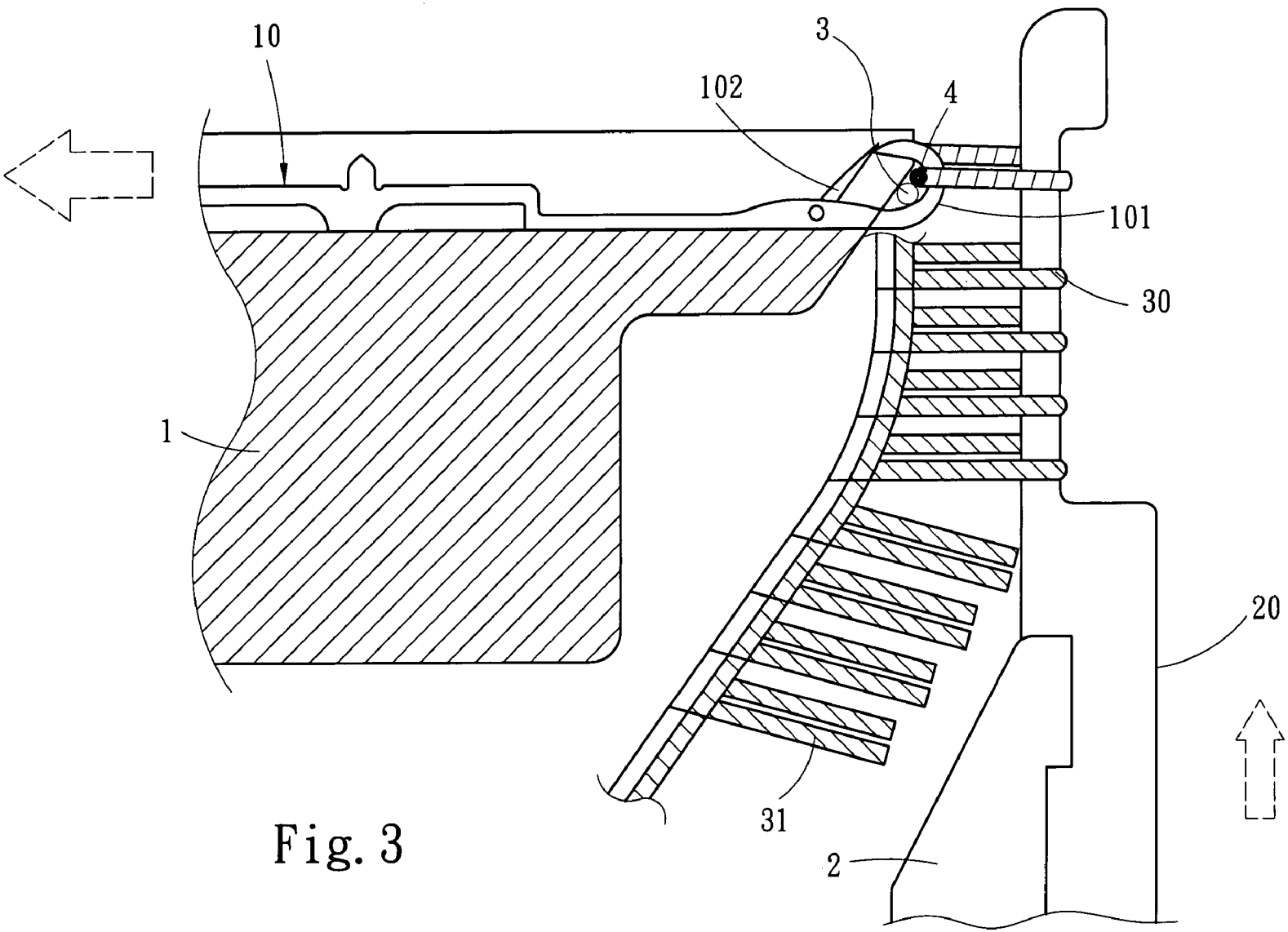
FIG. 3 is a schematic side view of the invention.

Referring to FIG. 3 for the structure of the yarn clamp assembly of a knitting machine constituting a wrap weaving, and a latch 102, 112 of the first and second knitting needles 10, 11 is guided into the yarn clamping section 101, 111 of the base yarn 4, such that the base yarn 4 and the wool yarn 3 form a wrap knitting status of pressing the base yarn 4 onto the wool yarn 3. The foregoing two fixing loops B improve the connecting strength of the loop 30 formed by the wrap knitting method with the base fabric. Therefore, the loop 30 is pulled by external forces and has a solid bottom structure to prevent the fabric structure from being damaged.

Figure 4:
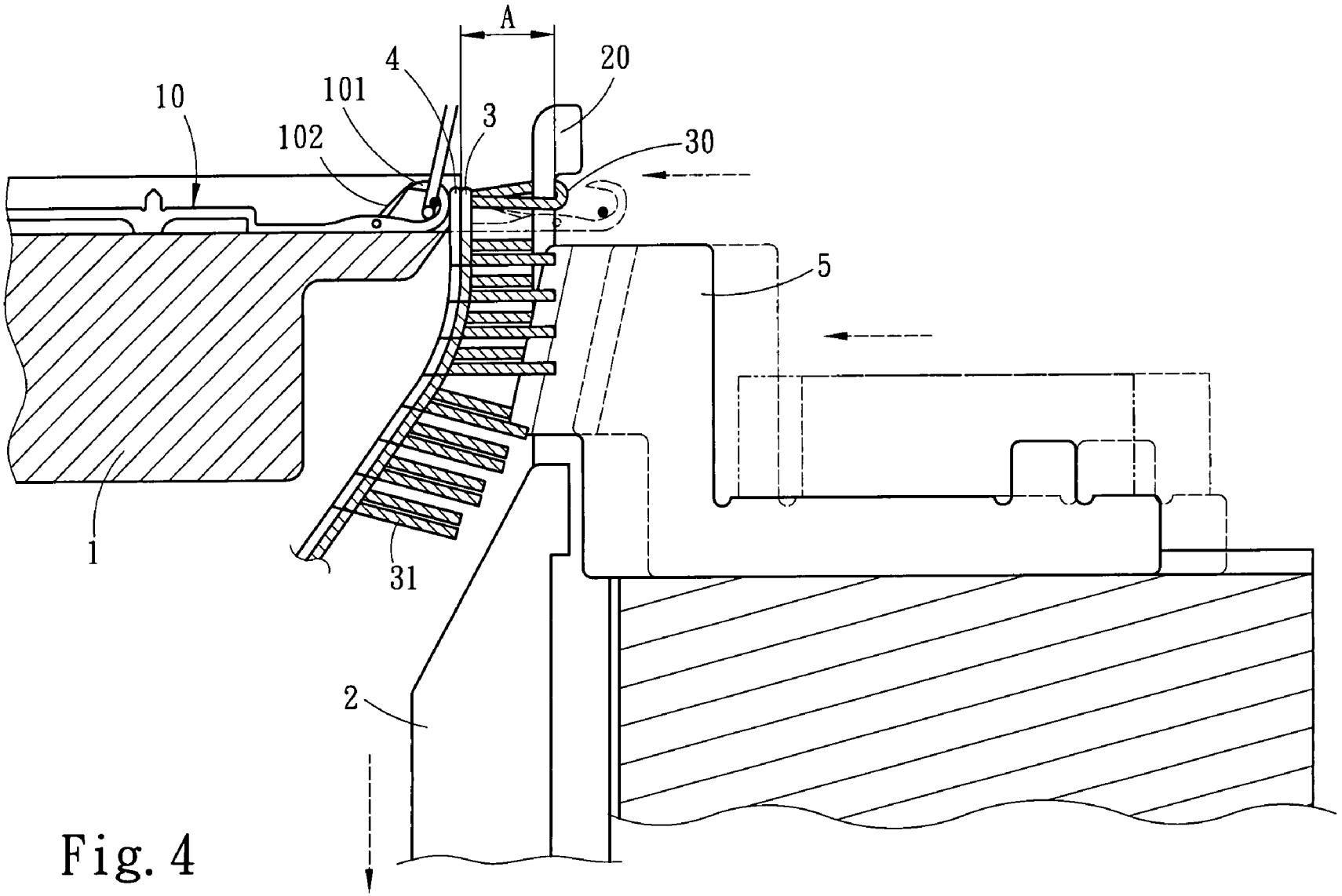
FIG. 4 is schematic view of a preferred embodiment of the invention.

Referring to FIG. 4 for another preferred embodiment of the present invention, the foregoing yarn clamp assembly of the knitting machine can attach the bottom of the loop 30 to the base fabric of the fabric and will not be loosened easily, so that the yarn clamp assembly can be applied to the warp knitting method to weave fabric with cut piles 31 as shown in FIG. 4, so that the bottom of the cut piles 31 produced by the wrap knitting method can be secured onto the fabric base of the fabric.

To form the cut piles 31, a cutter 5 is installed at the lateral side of the entry needle 20 for cutting the top of the loop 30, and the bottom of the loop 30 is connected securely by the two fixing loops B, and then the entry needle 20 continues its movement. The cutter 5 cuts the loop 30 situated at the top of the entry needle 20 to form the cut pile 31. This method is used to produce the cut piles 31 of the fabric. Since the bottom of the cut pile 31 secures the two fixing loops B into the fabric base of the fabric, so that the connecting structure of the two will be increased greatly, and the fabric having cut piles 31 uneasy to fall is produced.

Refer to FIG. 4 for the schematic view of a further preferred embodiment of the present invention. To increase the length of the foregoing loop 30 or cut pile 31 to meet the requirements, the gap A between the needle disc 1 and the entry needle barrel 2 is increased, so that the distance between the second hooking yarn point and the entry needle 20 formed at the top of the loop 30 is increased, and the distance between the bottom of the loop 30 and the top of the loop 30 is increased correspondingly (as described above, the loop 30 is cut and processed by the cutter 5 to produce cut piles 31), and the loop 30 or cut pile 31 of approximately 15 mm long is produced.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A yarn clamp assembly of a knitting machine, being installed onto a knitting machine and using a wrap knitting method to knit a fabric having a loop on one side, said yarn clamp assembly comprising:

a plurality of entry needles for forming a plurality of needling spaces among said entry needles; and a first and a second knitting needles, disposed in said needling space, the plurality of entry needles being transversally and separately disposed from the first and second knitting needles, each of the entry needles having a first knitting needle and a second knitting needle;

a yarn clamping section of said first and second knitting needles hooking a wool yarn at a circular position to form a loop on said entry needle between said first and second knitting needles;

said first and second knitting needles also hooking a base yarn, the base yarn being formed on said fabric base of said fabric, and being hooked at a circular position of said base yarn where said wool yarn is hooked by said first and second knitting needles, and said two fixing loops formed are coupled onto said wool yarn.

2. The yarn clamp assembly of a knitting machine of claim 1, wherein said plurality of entry needles are installed at an entry needle dial of said knitting machine, and said first and second knitting needles are installed onto a needle cylinder of said knitting machine.

3. The yarn clamp assembly of a knitting machine of claim 2, wherein said entry needle dial and said needle cylinder have a distance corresponding to the length of said loop.

4. The yarn clamp assembly of a knitting machine of claim 1, wherein said first and second knitting needles respectively include a needle latch, and said base yarn is guided into said yarn clamping section by said needle latch.

5. A yarn clamp assembly of a knitting machine, being installed onto a knitting machine and using a wrap knitting method to knit a fabric having a loop on one side, and said yarn clamp assembly comprising:

a plurality of entry needles for forming a plurality of needling spaces among said entry needles;

a first and a second knitting needles, disposed in said needling space, the plurality of entry needles being transversally and separately disposed from the first and second knitting needles, each of the entry needles having a first knitting needle and a second knitting needle;

a yarn clamping section of said first and second knitting needles hooking and pulling a wool yarn at a circular position of the wool yarn to form a loop on said entry needle between said first and second knitting needle, the wool yarn forming a cut pile surface;

said first and second knitting needles also hooking a base yarn, forming said base fabric of said fabric and being pulled at a circular position of said base yarn where said first and second knitting needles of said wool yarn are hooked, and two fixing loops fixed onto said wool yarn being formed; and a cutter, disposed on a lateral side of said entry needle, for cutting said loop to form said yarn wool, when the bottom of said loop is connected by said two fixing loops.

6. The yarn clamp assembly of a knitting machine of claim 5, wherein said plurality of entry needles are installed at said entry needle dial of said knitting machine, and said first and second knitting needles are installed at a needle cylinder of said knitting machine.

7. The yarn clamp assembly of a knitting machine of claim 6, wherein said entry needle dial and said needle cylinder have a distance corresponding to the length of said loop.

8. The yarn clamp assembly of a knitting machine of claim 5, wherein said first and second knitting needles respectively include a needle latch, and said base yarn is guided into said yarn clamping section by said needle latch.

* * * * *